US008424116B2

(12) United States Patent
Anastsopoulos et al.

(10) Patent No.: US 8,424,116 B2
(45) Date of Patent: Apr. 23, 2013

(54) SOCK

(75) Inventors: Mia Anastsopoulos, Nunawading (AU); Dane Totham, Nunawading (AU); Anne Van Veen, Nunawading (AU); James Jones, Nunawading (AU)

(73) Assignee: 7933657 Canada, Inc., Montreal (CA)

( * ) Notice: Subject to any disclaimer, the term of this patent is extended or adjusted under 35 U.S.C. 154(b) by 840 days.

(21) Appl. No.: 12/281,681

(22) PCT Filed: Mar. 6, 2007

(86) PCT No.: PCT/AU2007/000276

§ 371 (c)(1), (2), (4) Date: Sep. 4, 2008

(87) PCT Pub. No.: WO2007/101300

PCT Pub. Date: Sep. 13, 2007

(65) Prior Publication Data

US 2009/0044313 A1 Feb. 19, 2009

(30) Foreign Application Priority Data

Mar. 7, 2006 (AU) ..... 2006901151
Nov. 3, 2006 (AU) ..... 2006906129

(51) Int. Cl.
*A41B 11/00* (2006.01)
*A43B 17/00* (2006.01)

(52) U.S. Cl.
USPC ..... 2/239

(58) Field of Classification Search ..... 2/239, 240, 2/241, 242, 409; 66/178 R, 182, 185, 178 A; 602/62, 65, 66
See application file for complete search history.

(56) References Cited

U.S. PATENT DOCUMENTS

| | | | | | |
|---|---|---|---|---|---|
| 1,496,724 | A | * | 6/1924 | Mirsky | 66/182 |
| 2,018,248 | A | * | 10/1935 | Borner | 66/187 |
| 2,050,535 | A | * | 8/1936 | Martel | 66/178 R |
| 2,102,368 | A | * | 12/1937 | Martel | 66/182 |
| 2,219,235 | A | * | 10/1940 | Morton | 2/239 |
| 2,223,102 | A | * | 11/1940 | Grosse | 66/182 |
| 3,068,675 | A | * | 12/1962 | Payne, Jr. | 66/182 |
| 3,241,340 | A | * | 3/1966 | Knohl | 66/185 |
| 3,443,404 | A | * | 5/1969 | Knohl | 66/178 A |
| 4,255,949 | A | * | 3/1981 | Thorneburg | 66/185 |
| 4,263,793 | A | * | 4/1981 | Safrit et al. | 66/185 |
| 4,341,097 | A | * | 7/1982 | Cassidy et al. | 66/187 |
| 4,522,044 | A | * | 6/1985 | Lineberry et al. | 66/185 |
| 4,732,015 | A | * | 3/1988 | Abrams et al. | 66/172 E |
| 4,745,917 | A | * | 5/1988 | Hasty et al. | 602/63 |
| 4,898,007 | A | * | 2/1990 | Dahlgren | 66/185 |
| 5,103,656 | A | * | 4/1992 | Hanson, II | 66/185 |
| 5,335,517 | A | * | 8/1994 | Throneburg et al. | 66/185 |
| 5,412,957 | A | * | 5/1995 | Bradberry et al. | 66/178 A |

(Continued)

FOREIGN PATENT DOCUMENTS

| | | |
|---|---|---|
| DE | 19618919 A | 7/1997 |
| EP | 02655395 | 4/1988 |

(Continued)

*Primary Examiner* — Alissa L Hoey

(57) ABSTRACT

A sock having a toe portion, a heel and ankle portion, and a body portion disposed between the heel and ankle portion is disclosed. The body portion may comprise one or more elastic panels, which are incorporated in a manner to allow the sock to fit a wider range of standard foot sizes than a similar sock lacking the elastic panels disclosed herein.

13 Claims, 2 Drawing Sheets

U.S. PATENT DOCUMENTS

| | | | | |
|---|---|---|---|---|
| 5,603,232 | A * | 2/1997 | Throneburg | 66/185 |
| 5,617,745 | A * | 4/1997 | Della Corte et al. | 66/178 A |
| 5,708,985 | A * | 1/1998 | Ogden | 2/239 |
| 5,771,495 | A * | 6/1998 | Turner et al. | 2/239 |
| 6,092,397 | A * | 7/2000 | Cortinovis | 66/184 |
| 6,684,412 | B2 * | 2/2004 | Ricci et al. | 2/240 |
| 6,708,348 | B1 * | 3/2004 | Romay | 2/239 |
| 6,735,988 | B1 * | 5/2004 | Honeycutt | 66/185 |
| 7,192,411 | B2 * | 3/2007 | Gobet et al. | 602/63 |
| 7,757,518 | B2 * | 7/2010 | Sho et al. | 66/185 |
| 7,950,071 | B2 * | 5/2011 | Jeong | 2/239 |
| 7,971,280 | B2 * | 7/2011 | Kaneda | 2/239 |
| 2002/0023288 | A1 * | 2/2002 | Garneau | 2/239 |
| 2002/0095716 | A1 * | 7/2002 | Solwey | 2/239 |
| 2003/0230121 | A1 * | 12/2003 | Yokoyama | 66/178 A |
| 2006/0021389 | A1 * | 2/2006 | Menzies | 66/185 |
| 2006/0085894 | A1 * | 4/2006 | Yakopson et al. | 2/239 |
| 2006/0218973 | A1 * | 10/2006 | Kim et al. | 66/178 R |
| 2007/0135749 | A1 * | 6/2007 | Williams et al. | 602/62 |
| 2008/0155731 | A1 * | 7/2008 | Kasahara | 2/240 |
| 2008/0249454 | A1 * | 10/2008 | Mills | 602/63 |
| 2009/0000339 | A1 * | 1/2009 | Dahlgren | 66/187 |
| 2009/0013450 | A1 * | 1/2009 | Lambertz | 2/239 |
| 2009/0018482 | A1 * | 1/2009 | Lambertz | 602/65 |
| 2009/0044313 | A1 * | 2/2009 | Anastsopoulos et al. | 2/241 |
| 2009/0126081 | A1 * | 5/2009 | Lambertz | 2/239 |
| 2009/0158504 | A1 * | 6/2009 | Sparrow et al. | 2/239 |
| 2009/0165190 | A1 * | 7/2009 | Araki et al. | 2/240 |
| 2009/0178179 | A1 * | 7/2009 | Liu | 2/239 |
| 2009/0223254 | A1 * | 9/2009 | Ishida | 66/185 |
| 2009/0276939 | A1 * | 11/2009 | Sho et al. | 2/239 |
| 2009/0282607 | A1 * | 11/2009 | Kaneda | 2/239 |
| 2009/0288451 | A1 * | 11/2009 | Yokoyama | 66/185 |

FOREIGN PATENT DOCUMENTS

| | | | |
|---|---|---|---|
| FR | 2819270 | A | 7/2002 |
| JP | 2000017548 | A | 1/2000 |
| JP | 2005029934 | A | 2/2005 |
| WO | 2005/063062 | | 7/2005 |

* cited by examiner

SOCK

FIELD OF THE INVENTION

The present invention relates to socks. More particularly, the invention relates to socks that are relatively highly stretchable.

BACKGROUND OF THE INVENTION

Standard market size ranges are provided for socks, such that a sock of a particular size range is capable of being worn by any person with a foot within that size range. An example of standard sock size ranges commonly used by a number of sock manufacturers in Australia is set out below:—

| Category | Standard size range for each sock size | Ages |
|---|---|---|
| Infants | 000-00 | 0-6 mths |
| | 00-1 | 6-12 mths |
| | 1-2 | 1-3 yrs |
| | 2-4 | 3-5 yrs |
| Children | 5-8 | 5-8 yrs |
| | 9-12 | 8-10 yrs |
| | 13-3 | 10+ yrs |
| Teens | 2-8 | Teens |
| Adults - Men | 6-10 | Teens up |
| | 11-14 | to adults |
| Adults - Women | 3-8 | Teens up |
| | 6-10 | to adults |

Infants' and children's feet grow at such a rapid rate that shoes and socks are typically grown out of before they are worn out. Currently, if a parent buys socks for their child that is one year old and has a size 1 foot, the child can wear that sock for a maximum of two years until he or she has outgrown the sock and needs to move to a bigger size. If the child needs new socks when they are two and a half years old, with a size 2 foot, then the child can only wear the sock for six months before it is too small. However, the next size range up would be too big for the child's foot, as it is sized to fit up to a size 4.

As shown by the above table there are currently twelve different sock size ranges. This requires a manufacturer to produce twelve versions of everything from labels and packaging to shipping boxes. Retail outlets are required to provide shelf space for each type of sock in the different ranges. This means that in the infant department, each type of sock takes up four spaces. In the children's/teens department each type also takes up four spaces. In each of the men's and women's departments two spaces are required.

It is therefore an object of the present invention to provide a sock, or a collection of socks, that overcomes at least some of the above-mentioned problems.

SUMMARY OF THE INVENTION

In accordance with the invention, it has been realised that the objective can in part be met by the recognition that it is feasible to depart from the standard sock size ranges.

The invention provides, in a first aspect, a sock having a toe portion and a heel and ankle portion joined by a generally tubular body portion, wherein the body portion is formed in a composite fabric of an elastane and one or more other components such that the elastane density varies in the body portion in a manner effective to allow the sock to fit a wider range of standard foot sizes than for a similar sock having uniform elastane density in the body portion.

Preferably, said elastane density varies in the body portion by virtue of the body portion including one or more panel(s) of relatively higher elastane density separating, in a direction extending from the toe portion to the heel and ankle portion, panels of relatively lower elastane density.

Advantageously, a stitch length of the thread e.g. the course length, in the relatively higher elastane density panel(s) is greater than for the corresponding stitches in the panels of relatively lower elastane density.

In one embodiment, the respective panels of relatively higher and lower elastane density may conveniently be continuous bands arranged alternatively in said body portion of the sock. In a preferred embodiment, there is provided a single continuous band of relatively higher elastane density. The single band is advantageously positioned generally at the centre of the tubular body portion. The single band is typically positioned in that part of the sock that, when worn, is at the arch of the foot.

The invention provides, in a second aspect, a sock having a toe portion and a heel and ankle portion joined by a generally tubular body portion, wherein the body portion is formed in a composite fabric of an elastane and one or more other components and the body portion has one or more panels in which the stitch length of the thread, e.g. the course length is greater than for the corresponding stitches in the remainder of the sock.

Preferably, the composite fabric of said panels of relatively lower elastane density also forms said toe portion and said heel and ankle portion.

In the second aspect, the panel(s) may comprise one or more continuous bands arranged in said body portion of the sock. This may be a single continuous band. The single band is advantageously positioned generally at the centre of the tubular body portion. The single band is typically positioned in that part of the sock that, when worn, is at the arch of the foot.

In general, the density of the elastane in the panels of relatively higher elastane density may be between 1.5 and 3 times, for example about twice, the density of the elastane in the panels of relatively lower elastane density.

In an embodiment, the composite fabric comprises Lycra™ as the elastane and Nylon as another component. For the panels of relatively lower elastane density, suitable fabric is around 92% Nylon and 8% Lycra, in which case a suitable fabric for the panels of relatively higher elastane density is around 60% Nylon and 40% Lycra. As an alternative to Nylon, cotton may be used. In another suitable form of the invention, the higher elastane density material may be 60% Cotton and 40% Lycra. Typically, the higher elastane density panels have a 20% stronger recovery than the lower elastane density panels.

In another preferred embodiment, the fabric includes two threads, 2/30 ECC (English cotton count) cotton plated with around 92% Nylon and 8% Lycra. The panels of relatively higher elastane density include an additional thread of around 55% Nylon and 45% Lycra. In another preferred embodiment, the fabric includes two threads, 1/14 corespun ECC cotton plated with around 92% Nylon and 8% Lycra. The panels of relatively higher elastane density include an additional thread of around 60% Nylon and 40% Lycra.

In a further preferred embodiment, the fabric includes two threads. The panels of relatively higher elastane density include a substitute thread of higher elastane density. For example, a thread of 92% Nylon and 8% Lycra is replaced with a thread of 60% Nylon and 40% Lycra in the panel of relatively higher elastane density.

The invention provides, in a third aspect, a sock having a toe portion and a heel and ankle portion joined by a generally tubular body portion, wherein the body portion is formed in a composite fabric of an elastane and one or more other components and the body portion has one or more panels with at least one additional thread of elastane provided in each course in the panel(s) to provide a relatively higher elastane density than in the remainder of the sock.

The heel sub-portion of the heel and ankle portion, and the toe portion, may be reinforced with additional Nylon on the fabric, e.g. on the outside of the fabric. This may be affected by reverse plating with extra Nylon.

The sock is advantageously a sock sized to be worn by children. In this case, the wider range of standard foot sizes preferably consists of four or more Australian or U.S. infants foot sizes, for example 000 to 1, or six or more non-infants children's sizes, for example 1 to 5 or 13 to adult 5 (both six standard size ranges), or 6 to 14 (a nine standard size range).

In a fourth aspect, the invention provides a collection of socks differing only in size, intended to be displayed for sale at a common location, which socks are so formed in composite fabric of an elastane and one or more other components that the socks of the collection have only four distinct sizes able to fit feet over the children's size ranges, e.g. Australian sizes: infant 000-adult 5.

The fourth aspect of the invention is advantageously effected by socks according to the first, second or third aspect of the invention.

BRIEF DESCRIPTION OF THE DRAWINGS

The invention will now be described, by way of example only, with reference to the accompanying drawing, which.

DETAILED DESCRIPTION OF THE EMBODIMENTS

Figure 1:
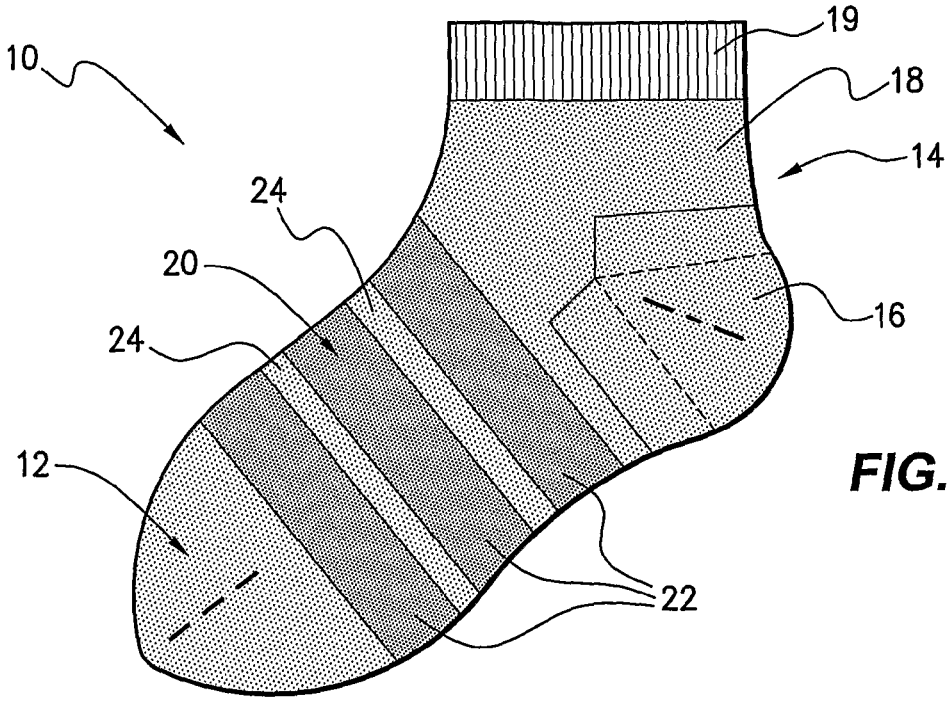
FIG. 1 is a side view of a sock according to a first embodiment of the present invention.

As can be seen from FIG. 1, a sock 10 is provided having a toe portion 12 and a heel and ankle portion 14. The heel and ankle portion 14 comprises a heel sub-portion 16 and an ankle sub-portion 18 having a suitable elastic cuff portion 19 formed integrally with the upper end of the ankle sub-portion 18. The heel and ankle portion 14 is joined to the toe portion 12 by a generally tubular body portion 20.

The sock 10 is formed in the conventional manner using a standard circular knitting machine.

The body portion 20 is formed in a composite fabric of elastane and one or more other components, such as Nylon, cotton or any other suitable yarn. The elastane is preferably, spandex such as Lycra™. The elastane density varies in the body portion 20 by virtue of having one or more panels 22 of relatively higher elastane density separated in a direction extending from the toe portion 12 to the heel and ankle portion 14 by panels 24 of relatively lower elastane density.

The panels 22 of relatively higher elastane density and the panels 24 of relatively lower elastane density are formed as continuous bands arranged in succession in the body portion 20. The continuous bands extend around the entire body portion 20 in the direction of the courses of knitting. It will be appreciated that while the bands 22, 24 illustrated in FIG. 1 are of a uniform width, the width of the bands may vary and may take alternative forms, such as having a zig-zag profile. The bands 22, 24 may be knitted and dyed in a uniform colour such that the bands are not clearly visible. Alternatively, the bands may be shaped and dyed to create a pattern or visual feature on the sock.

The panels 22 of relatively higher elastane density have typically twice the elastane density as the panels 24 of relatively lower elastane density. Such a composite fabric for the lower elastane density panels 24 could be around 92% Nylon and 8% Lycra, with the higher elastane density panels 22 being around 60% Nylon and 40% Lycra. The higher elastane density panel will typically have a minimum of 20% stronger recovery than the lower elastane density panel.

The elastane density of the toe portion and heel and ankle portion will typically be of the same or similar density as the lower elastane density panels 24. The toe portion 12 and heel sub-portion 16 will generally be reverse plated with extra Nylon on the outside of the fabric.

Figure 2:
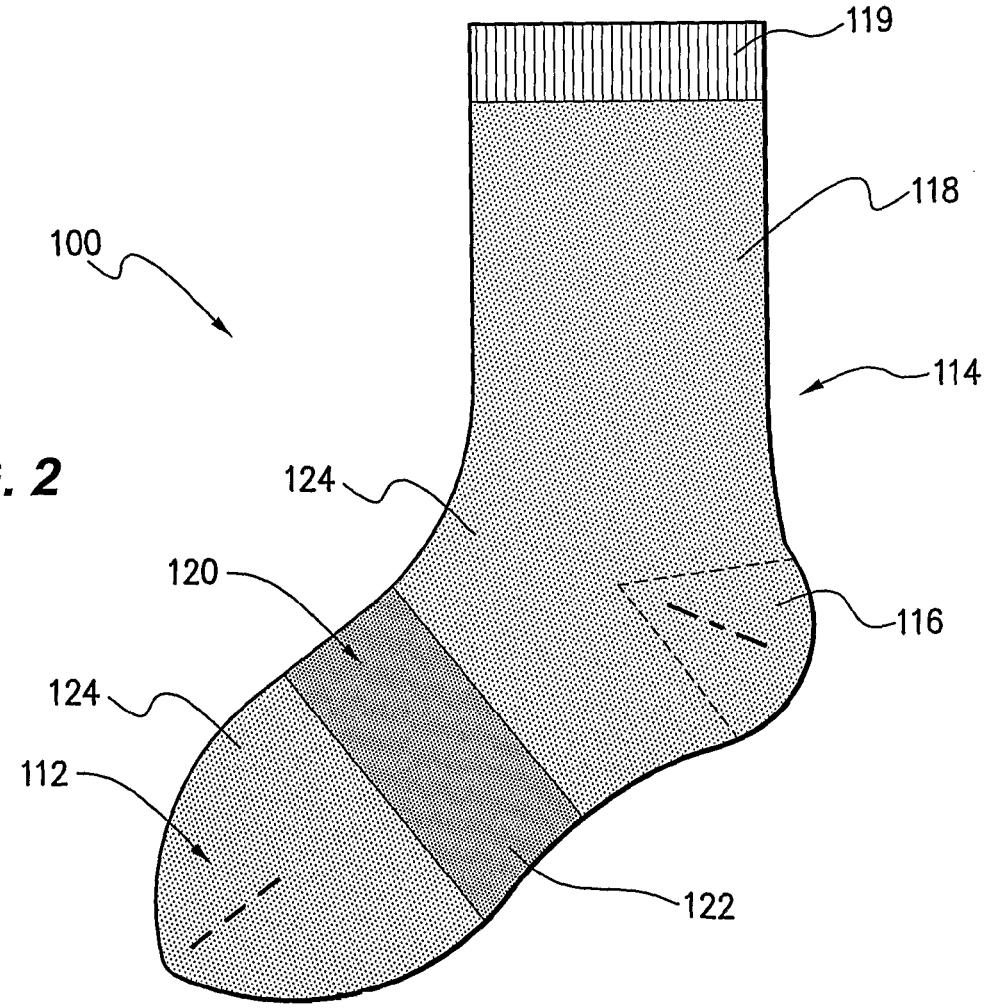
FIG. 2 is a side view of a sock according to a second embodiment of the present invention.

In the sock 100 illustrated in FIG. 2, there is provided a single continuous band 122 of relatively higher elastane density separating, in a direction extending from the toe portion 112 to the heel and ankle portion 114, panels 124 of relatively lower elastane density. The location of the band 122 is generally in the centre of the body portion 120, being at approximately the arch of the foot. The fabric includes two threads, 2/30 ECC (English cotton count) cotton plated with around 92% Nylon and 8% Lycra. The panels of relatively higher elastane density include an additional thread of around 55% Nylon and 45% Elastane. This particular construction is suited to a type of sock commonly referred to as a 'School trainer'.

Figure 3:
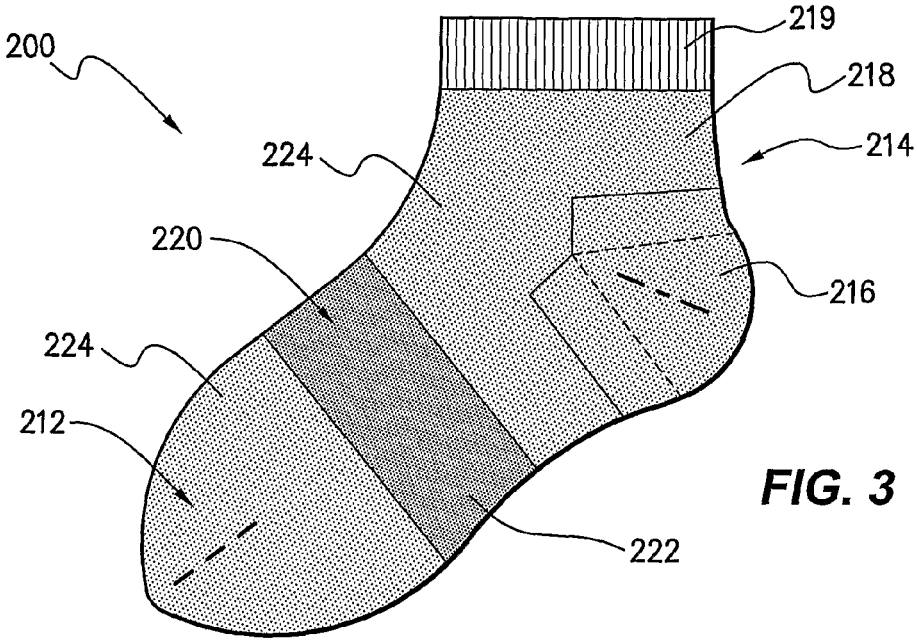
FIG. 3 is a side view of a sock according to a third embodiment of the present invention.

In the sock 200 illustrated in FIG. 3, there is again provided a single continuous band 222 of relatively higher elastane density separating, in a direction extending from the toe portion 212 to the heel and ankle portion 214, panels 224 of relatively lower elastane density. The fabric includes two threads 230, 232 (shown in FIG. 4), 1/14 corespun ECC cotton plated with around 92% Nylon and 8% Lycra. The panels of relatively higher elastane density include an additional thread 234 of around 60% Nylon and 40% Lycra. This particular construction is suited to a type of sock commonly referred to as a 'School crew' or 'knee hi'.

Figure 4:
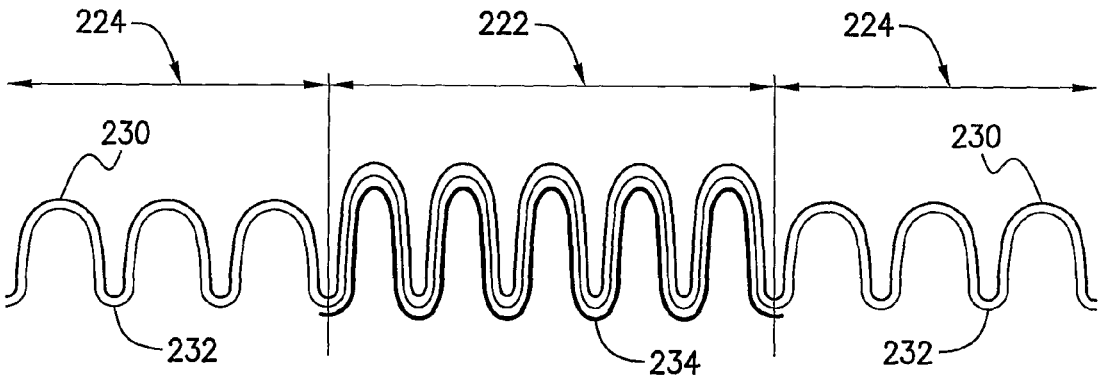
FIG. 4 is a diagrammatic representation of a cross-section of the threads forming a sock according to the present invention.

As can be seen from FIG. 4, as well as an additional thread of Lycra-Nylon in the band 222, the length of the course stitches (or the course length) for all three threads 230, 232, 234 is greater in this section. The combination of these features allows the band 222 to stretch approximately three times its relaxed measurement, and the use of the additional elastane allows it to fully recover after use.

Figure 5:
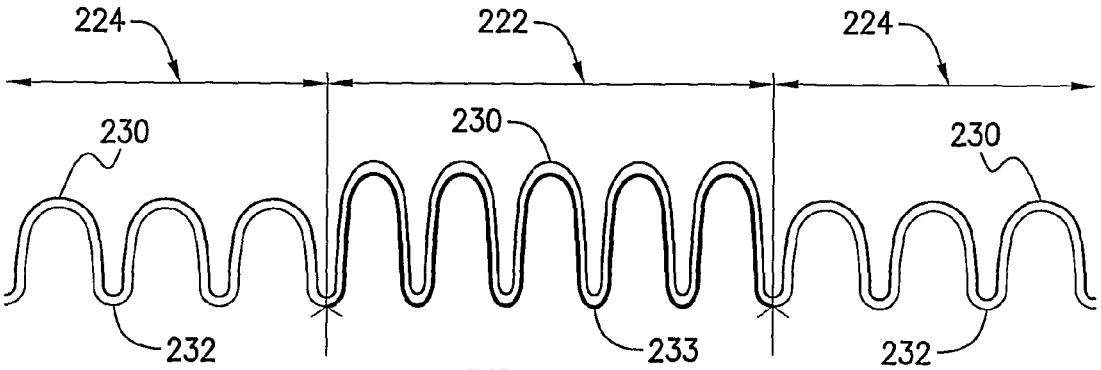
FIG. 5 is a diagrammatic representation similar to FIG. 4 of a sock according to another embodiment of the present invention.

FIG. 5 shows an alternative solution to that shown in FIG. 4. Instead of the additional thread 234, the second thread 232 is replaced in the band 222 with an alternate thread 233. The substitute thread is around 60% Nylon and 40% Lycra rather than 92% Nylon and 8% Lycra.

The advantage of the relatively higher elastane density panels 22 are their high stretch and high recovery. As the stretch of the panels 22 is relatively high, the body portion 20 of the sock 10 is able to vary in a manner effective to allow the sock 10 to fit a wider range of standard foot sizes than for a similar sock having uniform elastane density in the body portion. The body portion 20 is able to stretch in length and in diameter, such that as a foot grows, the sock is able to stretch to the larger foot size in the size range. The relatively high recovery rate allows the body portion 20 to consistently regain its smaller, unstretched size when not being worn.

An example of sock size ranges for a collection of socks according to the present invention is set out below:—

| Category | Size range for each sock size | Ages |
|---|---|---|
| Infant | 000-1 | 0-18 months |
| | 1-5 | 18 mths-3 yrs |
| | 6-12 | 3-6 years |
| Children | 13-5 | 6-10 years |
| | 5-10 | Teens |
| Adults - men | 6-14 | Teens up to |
| Adults - women | 3-10 | adults |

As shown by the above table the number of size ranges have been reduced from twelve to seven. As can be seen, the infant size ranges have been reduced from four to two. Only one sock size range each is required for men and women to cover all of their sock sizes. The sock 10 being able to fit a wider range of standard foot sizes means that manufacturers can reduce the number of different socks produced, additionally reducing costs associated with packaging and transport. Retail outlets will be able to reduce the shelf space for each type of sock, allowing them to increase their diversity of product.

One of the biggest advantages of the sock construction is that, within one household, socks 10 can be worn by several different children. By producing a sock that is able to grow with the child, a child is less likely to out-grow their socks before they wear them out. This reduces the number of socks that parents are required to buy as their child progresses through the sock size ranges. The ability for children of different ages and sock sizes to share their socks means that the variety of different socks required by a household can be reduced, reducing overall clothing costs for a household.

It will be understood that the invention disclosed and defined in this specification extends to all alternative combinations of two or more of the individual features mentioned or evident from the text or drawings. All of these different combinations constitute various alternative aspects of the invention.

The invention claimed is:

1. A sock comprising (i) a toe portion, (ii) a heel and ankle portion, and (iii) a body portion disposed between the toe portion and the heel and ankle portion, wherein the body portion comprises one or more elastic panels, wherein at least one elastic panel forms a continuous band that encircles the body portion of the sock, wherein the toe portion, the heel and ankle portion, the body portion, and the one or more elastic panels comprise a first type of thread and a second type of thread, the second type of thread comprising elastane;

wherein the one or more elastic panels further comprise a third type of thread comprising a higher amount of elastane than the second type of thread, such that the one or more elastic panels have an elastane density that is greater than the elastane density of both the toe portion and the heel and ankle portion; and wherein the one or more elastic panels have a greater stitch length than that of both the toe portion and the heel and ankle portion.

2. The sock according to claim 1, wherein the body portion comprises two or more elastic panels, which each form a continuous band that encircles the body portion of the sock.

3. The sock according to claim 1, wherein the body portion comprises a single elastic panel.

4. The sock according to claim 3, wherein the elastic panel is positioned at the center of the body portion of the sock.

5. The sock according to claim 1, wherein the one or more elastic panels have at least a 20% stronger recovery than the toe portion, the heel and ankle portion, or both the toe portion and the heel and ankle portion.

6. The sock according to claim 1, wherein the second type of thread further comprises nylon.

7. The sock according to claim 6, wherein the heel and ankle portion comprises a heel sub-portion, and wherein the exterior of the toe portion and the heel sub-portion are reinforced with nylon.

8. A sock, the sock comprising (i) a toe portion, (ii) a heel and ankle portion, and (iii) a body portion disposed between the toe portion and the heel and ankle portion, the body portion comprising one or more elastic panels;

wherein the toe portion, the heel and ankle portion, the body portion, and the one or more elastic panels comprise a first type of thread and a second type of thread, the second type of thread comprising an amount of elastane;

wherein the one or more elastic panels further comprise a third type of thread comprising a higher amount of elastane than the second type of thread, such that the one or more elastic panels have a higher elastane density and a greater stitch length than both the toe portion and the heel and ankle portion, and wherein at least one elastic panel forms a continuous band that encircles the body portion of the sock.

9. The sock according to claim 8, wherein the one or more elastic panels have an elastane density that is between 1.5 and 3 times the elastane density of both the toe portion and the heel and ankle portion.

10. The sock according to claim 8, wherein the body portion comprises a single elastic panel.

11. The sock according to claim 1, wherein the thread of the first thread type is plated with the thread of the second thread type.

12. The sock according to claim 8, wherein the thread of the first thread type is plated with the thread of the second thread type.

13. The sock according to claim 1, wherein the one or more elastic panels have an elastane density that is between 1.5 and 3 times the elastane density of both the toe portion and the heel and ankle portion.

* * * * *